US007305742B2

(12) United States Patent
Anderson

(10) Patent No.: US 7,305,742 B2
(45) Date of Patent: Dec. 11, 2007

(54) SEAL FOR ZIPPERED BAG

(75) Inventor: Brent Anderson, Barrington, IL (US)

(73) Assignee: CTI Industries Corporation, Barrington, IL (US)

( * ) Notice: Subject to any disclaimer, the term of this patent is extended or adjusted under 35 U.S.C. 154(b) by 59 days.

(21) Appl. No.: 10/293,145

(22) Filed: Nov. 13, 2002

(65) Prior Publication Data

US 2004/0091179 A1 May 13, 2004

(51) Int. Cl.
*A44B 19/16* (2006.01)
*A44B 19/36* (2006.01)

(52) U.S. Cl. ..... 24/400; 24/435

(58) Field of Classification Search ..... 24/384, 24/389, 399, 400, 585.12, 30.5 R, DIG. 50, 24/436; 383/63, 64, 61.3
See application file for complete search history.

(56) References Cited

U.S. PATENT DOCUMENTS 3,790,992 A 2/1974 Hertz
3,986,914 A 10/1976 Howard
4,523,918 A 6/1985 Ausnit
4,534,752 A 8/1985 Ferret et al.
4,620,320 A 10/1986 Sullivan
5,020,194 A 6/1991 Herrington et al.
5,067,208 A 11/1991 Herrington et al.
5,088,971 A 2/1992 Herrington et al.
5,131,121 A 7/1992 Herrington et al.
5,161,286 A 11/1992 Herrington et al.
5,301,395 A 4/1994 Richardson et al.
5,405,478 A 4/1995 Richardson et al.
5,426,830 A 6/1995 Richardson et al.
5,442,837 A 8/1995 Morgan
5,448,807 A 9/1995 Herrington, Jr.
5,482,375 A 1/1996 Richardson et al.
5,669,715 A 9/1997 Dobreski et al.
5,722,128 A 3/1998 Toney et al.
5,769,772 A 6/1998 Wiley
5,809,621 A 9/1998 McCree et al.
5,833,791 A 11/1998 Bryniarski et al.
5,836,056 A 11/1998 Porchia et al.
5,896,627 A 4/1999 Cappel et al.
5,924,173 A 7/1999 Dobreski et al.
5,947,603 A 9/1999 Tilman
5,950,285 A 9/1999 Porchia et al.
5,956,815 A 9/1999 O'Connor et al.
5,991,980 A 11/1999 Meager
6,033,113 A * 3/2000 Anderson ..... 383/63
6,178,602 B1 1/2001 Burke et al.
6,264,033 B1 * 7/2001 Kannabiran et al. ..... 206/459.1
6,286,189 B1 9/2001 Provan et al.
6,286,191 B2 9/2001 Van Erden
6,286,999 B1 9/2001 Cappel et al.
6,287,001 B1 9/2001 Buchman
6,293,701 B1 9/2001 Tomic
6,327,754 B1 12/2001 Belmont et al.

(Continued)

*Primary Examiner*—James R. Brittain
(74) *Attorney, Agent, or Firm*—Joseph A. Fuchs; Rockey, Depke & Lyons, LLC

(57) ABSTRACT

The present invention provides a recloseable bag, the bag having a mouth and including a closure at the mouth, the closure having a first end and a second end. The recloseable bag also includes a first crushed section at the first end of the closure, the closure further including an intact portion. It also includes a first transition area between the first crushed section and the intact portion, and a sealing material in the first transition area.

11 Claims, 8 Drawing Sheets

U.S. PATENT DOCUMENTS 6,347,437 B2 2/2002 Provan et al.
6,357,914 B1 * 3/2002 Kinigakis et al. ..... 383/64
6,364,530 B1 4/2002 Buchman
6,378,177 B1 4/2002 Athans et al.
6,389,780 B1 5/2002 Coomber et al.
6,412,254 B1 7/2002 Tilman et al.
6,431,754 B1 8/2002 Svicki, Sr.
6,449,924 B2 9/2002 McMahon et al.
6,461,042 B1 10/2002 Tomic et al.
6,508,969 B1 * 1/2003 Kolovich et al. ..... 264/252
6,846,107 B2 * 1/2005 Sweeney et al. ..... 383/64
2004/0022460 A1 * 2/2004 Plourde et al. ..... 383/64
2004/0066985 A1 * 4/2004 Patel et al. ..... 383/64

* cited by examiner 19
36
55
38
20
55
43
55
55
43
55
43
55
43
57

SEAL FOR ZIPPERED BAG

BACKGROUND OF THE INVENTION

The present invention relates to zippered bags, and more particularly, to an end seal used in connection with such bags. It is known to use airtight plastic bags and containers to conveniently store bulky materials such as clothing and bedding. Airtight plastic bags are also known to store food and other materials. Examples of such airtight bags are disclosed in U.S. Pat. Nos. 6,357,915; 6,116,781; and 5,480,030, each of which is incorporated herein by reference. Airtight bags allow air to be removed from bulky items such as comforters and sweaters, and the bag sealed to essentially "shrink" the items stored inside the bag. Air can be compressed from the contents, for example, by rolling the contents prior to closing the bag. The bags may also have a one-way valve to which a vacuum attachment can be affixed to evacuate the air from inside the bag using a conventional household vacuum cleaner. Removal of air reduces the amount of space necessary to store the items. When food items are stored, air can be squeezed from the bag prior to closing. The bags are typically made of materials such as bi-axial layers of nylon and polyethylene to make the bags air and moisture impermeable, and hold the airtight vacuum seal.

The bags have a zippered closure at the mouth of the bag. An example of a zippered closure is disclosed in U.S. Pat. No. 6,033,113, incorporated herein by reference. The zippered closure is typically made of plastic. Often associated with the zippered closure is a slider that facilitates sealing the zippered closure. The slider closes and can open the zippered closure. Examples of sliders include those disclosed in U.S. Pat. Nos. 6,306,071; 6,287,001; 6,264,366; 6,247,844; 5,950,285; 5,924,173; 5,836,056; 5,442,837; 5,161,286; 5,131,121; 5,088,971; and 5,067,208.

It is well known in the art of bagmaking to crush the ends of the zippered closures. The bags are longitudinally cut at the crushed sections or "end stomps" to create separate bags which typically are formed in a continuous web. When the zippered closure ends are crushed, the zippered closure is melted and deformed in such areas. Incorrect or incomplete crushing results in voids in the transition zone between the end stomp and the intact zipper profile through which air can travel. Thus, the bags will not be airtight.

SUMMARY OF THE INVENTION

The present invention provides a recloseable bag, the bag having a mouth and including a closure at the mouth, the closure having a first end and a second end. The recloseable bag also includes a first crushed section at the first end of the closure, the closure further including an intact portion. It also includes a first transition area between the first crushed section and the intact portion, and a sealing material in the first transition area.

In another aspect, the present invention provides a method for making a bag, the bag having a front, a back, and a mouth, and a closure at the mouth. The closure has a first end and second end. The method includes the steps of depositing a sealing material between the front and back of the bag at the first end of the closure, and crushing the first end of the closure to define a first crushed section and an intact portion.

The present invention also provides a zippered closure having a first end and a second end. The zippered closures also includes a front zipper profile and a back zipper profile, and a first crushed section at the first end of the zippered closure. The zippered closure further includes an intact portion, a first transition area between the first crushed section and the intact portion; and a sealing material in the first transition area.

The present invention further provides a method of making a bag having a zippered closure comprising the step of providing a first film having a first profile of the zippered closure attached thereto. The method also includes depositing at a location on the first profile a sealing material, and providing a second film in registration with the first film having a second profile of the zippered closure attached thereto. It further includes crushing the first and second profiles of the zippered closure at the deposit location.

The sealing material of the present invention fill voids occurring during creation of the end stomps, thus creating a gasket effect. This gasket effect helps seal the ends of the zippered closure to ensure the bags will be airtight. Additional features and advantages of the present invention are described in, and will be apparent from, the following Detailed Description of the Invention and the figures.

DETAILED DESCRIPTION OF THE INVENTION

Figure 1:
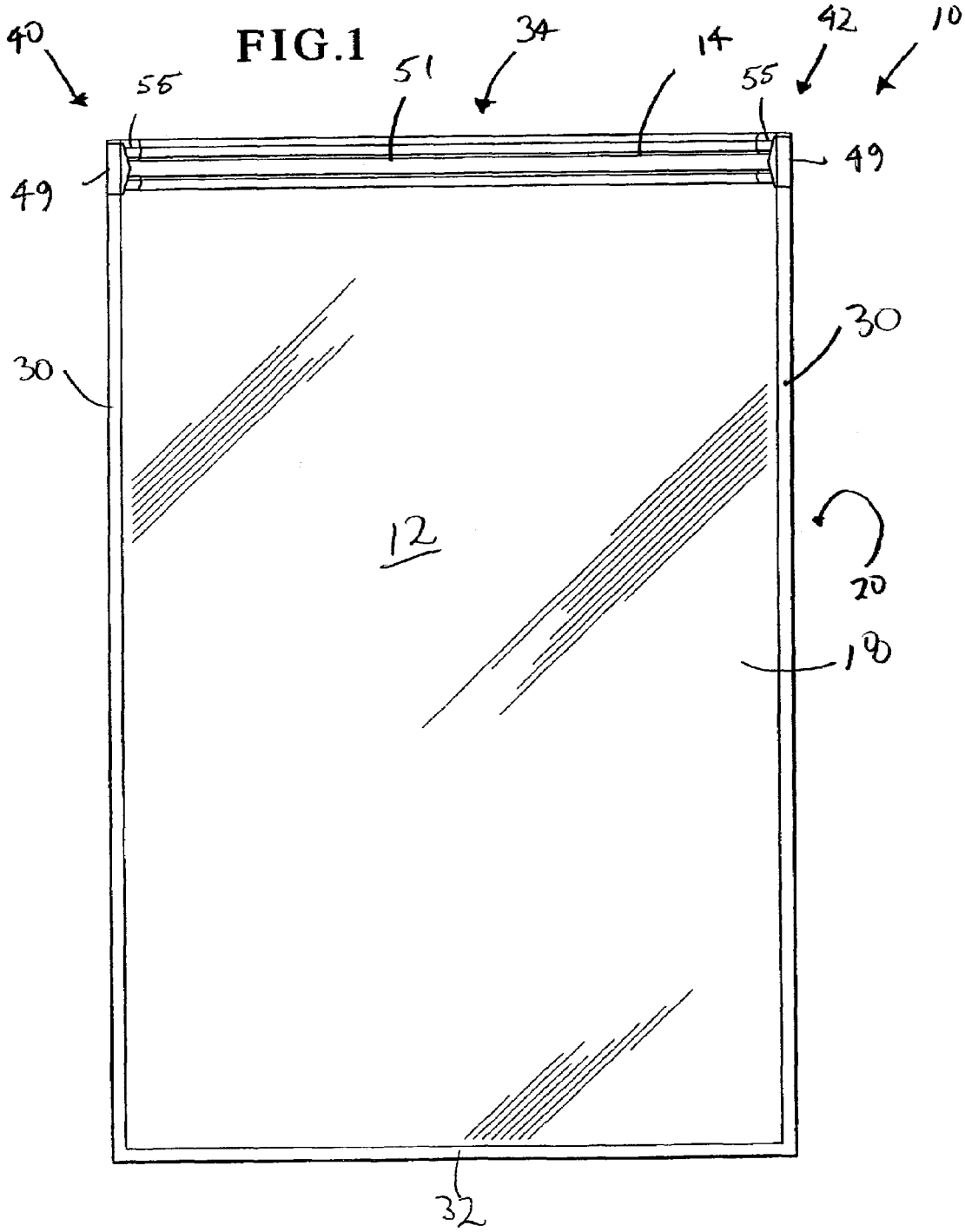
FIG. 1 is a plan view of a bag made in accord with an embodiment of the present invention.
Figure 5:
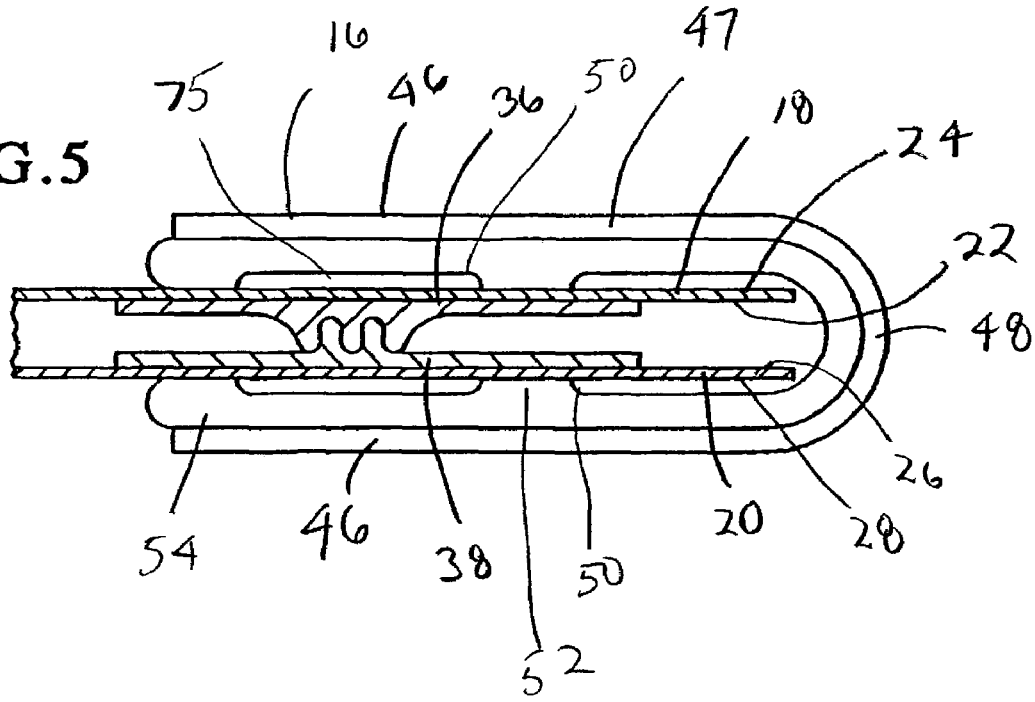
FIG. 5 is a cross-sectional view of a zippered closure and slider made in accord with an embodiment of the present invention.

FIG. 1 shows a bag assembly 10 made in accord with an embodiment of the present invention. The bag assembly 10 includes a bag 12, and a zippered closure 14. The bag 12 is formed from a front 18 and a back 20. The front 18 has an inner surface 22 and an outer surface 24. The back 20 has an inner surface 26 and an outer surface 28 (FIG. 5).

The front 18 and back 20 are preferably placed in registration and sealed along their side edges 30 and bottom 32 to form the bag 12. Any suitable means to seal the front 18 and back 20 may be used, but they are preferably heat sealed. The bag 12 has a mouth 34 which is not sealed.

The front 18 and back 20 may be a monolayer structure or a multiple layer structure. The multiple layer structures can be formed by coextrusion, extrusion, lamination, extrusion lamination, or other processes well known in the art. The front 18 and back 20 are preferably each made from bi-axial layers of polyethylene and nylon, but may be any suitable material or combination of materials, and may, in one embodiment, be airtight.

Figure 2:
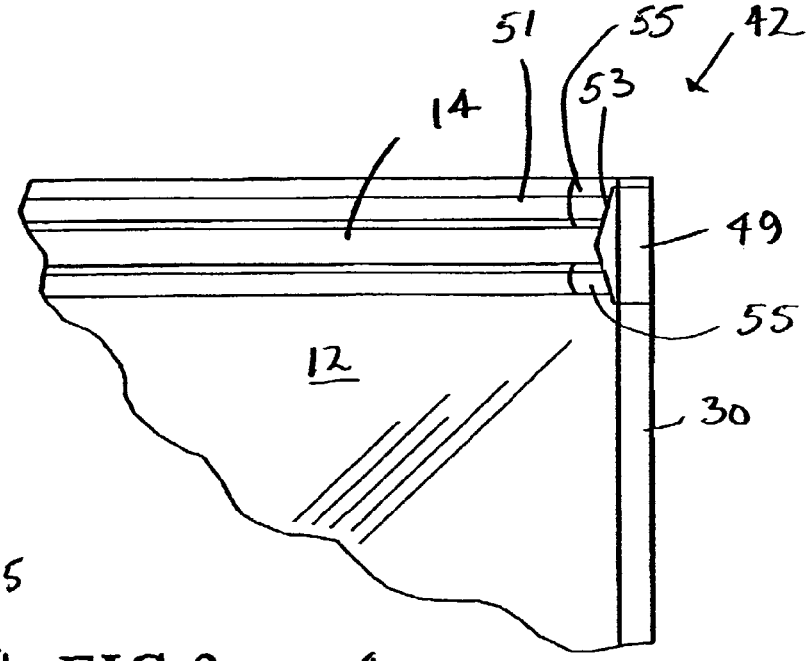
FIG. 2 is an enlarged view of one end of a bag made in accord with an embodiment of the present invention.
Figure 3:
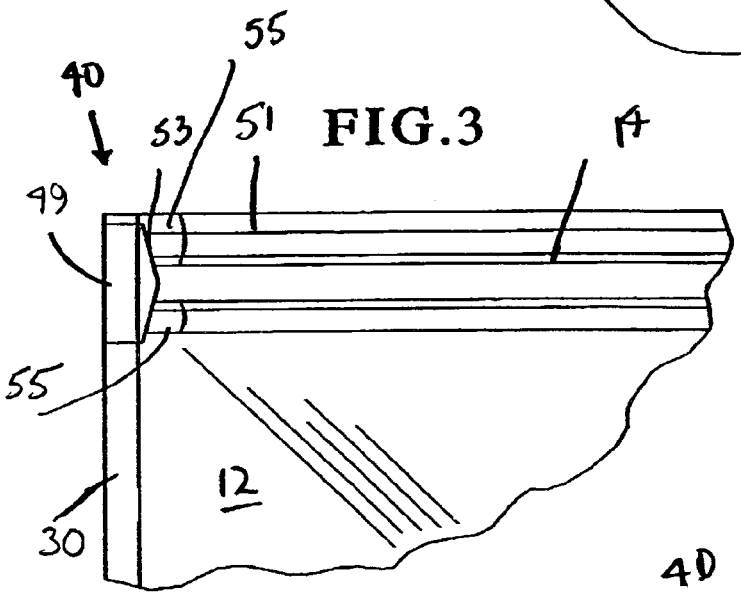
FIG. 3 is an enlarged view of the other end of a bag made in accord with an embodiment of the present invention.

FIGS. 2 and 3 show enlarged views of the bag 12 and zippered closure 14. The zippered closure 14 is located at a mouth 34 of the bag 12, and seals the mouth 34. The zippered closure 14 includes a front zipper profile 36 attached to the inner surface 22 of the front 18, and a back zipper profile 38 attached to the inner surface 26 of the back 20 (FIG. 5). The front zipper profile 36 and back zipper profile 38 are preferably heat sealed to the inner surfaces 22 and 26 of the front 18 and back 20, but may be attached using any suitable means, including adhesives. The front zipper profile 36 and back zipper profile 38 interlock to provide an airtight seal at the mouth 34 of the bag 12. The front zipper profile 36 and back zipper profile 38 are preferably configured and interlock as disclosed in U.S. Pat. No. 6,033,113.

The zippered closure 14 has a first end 40 and a second end 42 defining a length 44. The first end 40 and second end 42 of the zippered closure 14 are each melted, or "crushed," using heat sealing or ultrasonic sealing and pressure to define crushed sections or end stomps 49 and an intact portion 51 between the end stomps 49. "Crushing" is conventional in the art. Where the crushed sections 49 and intact portion 51 meet define transition areas 53.

Figure 4:
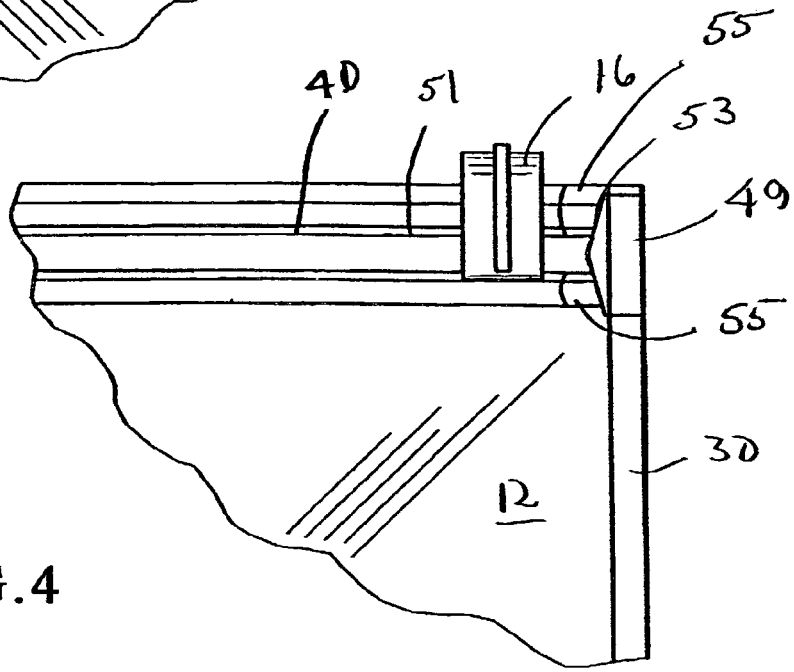
FIG. 4 is a enlarged view of one end of a bag with a slider made in accord with an embodiment of the present invention.

FIGS. 4 and 5 illustrate an embodiment of the present invention where a slider 16 in included to move along the zippered closure 14 opening and closing the zippered closure 14. As the slider 16 moves in one direction along the zippered closure 14, it opens the mouth 34 of the bag 12, and is it moves in the opposite direction, it closes the zippered closure 14. Sliders are well known in the art.

As shown in FIG. 5, the slider 16 has a body 47 including pair of legs 46 extending from opposite sides of a rounded portion 48. The legs 46 each have an inner profile 50 that permits them to seat on the zippered closure 14. The inner profile 50 has opposing top protrusions 52 and opposing bottom protrusions 54. The top protrusions 52 are above the zippered closure 14 and the bottom protrusions 54 are below the zippered closure 14. The slider 16 moves along the zippered closure 14 to open and close the zippered closure 14. The top and bottom protrusions 52 and 54 contact the outer surfaces 24 and 28 of the front 18 and back 20. The slider 16 is preferably made of a plastic material, and in a preferred embodiment is made of polyethylene, but may be made of any suitable material. A recessed portion 75 of each leg 46 accommodates the first and second zipper profiles 36 and 38. In another embodiment, the slider 16 may be of the type disclosed in U.S. patent application Ser. No. 10/225,026, entitled "Slider with Arm," filed Aug. 20, 2002, incorporated herein by reference.

FIG. 4 illustrates the slider 16 at the second end 42 of the bag 12 after the slider 16 has closed the mouth 34 of the bag 12. To close the mouth 34, the legs 46 are squeezed together by the user to force the front zipper profile 36 and back zipper profile 38 to interlock as the slider 16 moves from the first end 40 along the zippered closure 14 to the second end 42, thereby closing the zippered closure 14.

Figure 6:
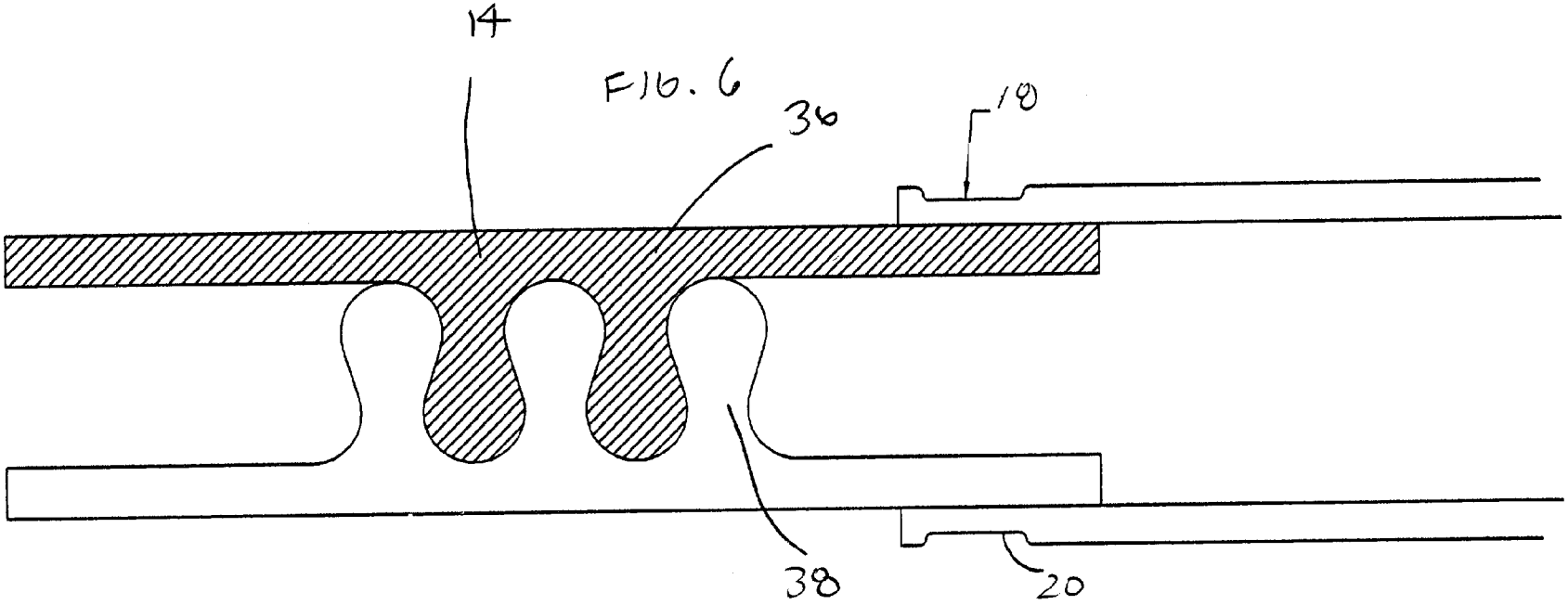
FIG. 6 is a schematic cross-sectional view of a zippered closure of a bag before crushing.
Figure 7:
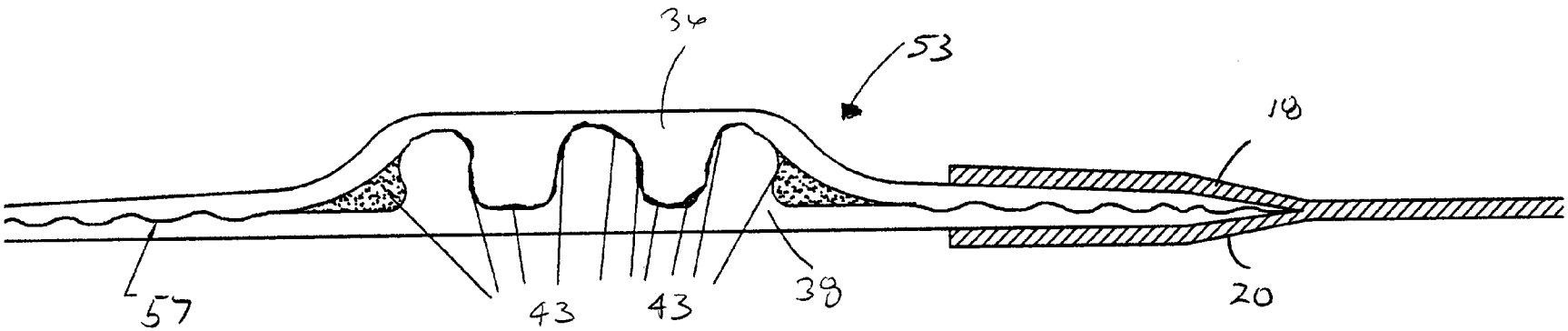
FIG. 7 is a schematic cross-sectional view of the zippered closure of FIG. 6 after crushing.

As shown in FIGS. 6 and 7, when the first and second ends 40 and 42 are crushed, voids 43 are created in the crushed section which permit air to penetrate the bag 12 through the voids 43. FIG. 6 is a cross-sectional schematic view of a typical zippered closure 14 before crushing. The front profile 36 and back profile 38 are attached to the front 18 and back 20 of the bag 12, respectively. The front profile 36 and back profile 38 are interlocked.

FIG. 7 is a cross-sectional schematic view of the zippered closure 14 at the transition area 53 between the crushed section 49 and intact portion 51 after crushing. As shown in FIG. 7, the zippered closure 14 is melted together at a melt line 57. Voids 43 are shown in the transition area 51 between the front profile 36 and back profile 38. Voids 43 permit air travel, thus reducing the airtightness of the zippered closure 14, and ultimately, the bag 12.

Figures 8, 9:
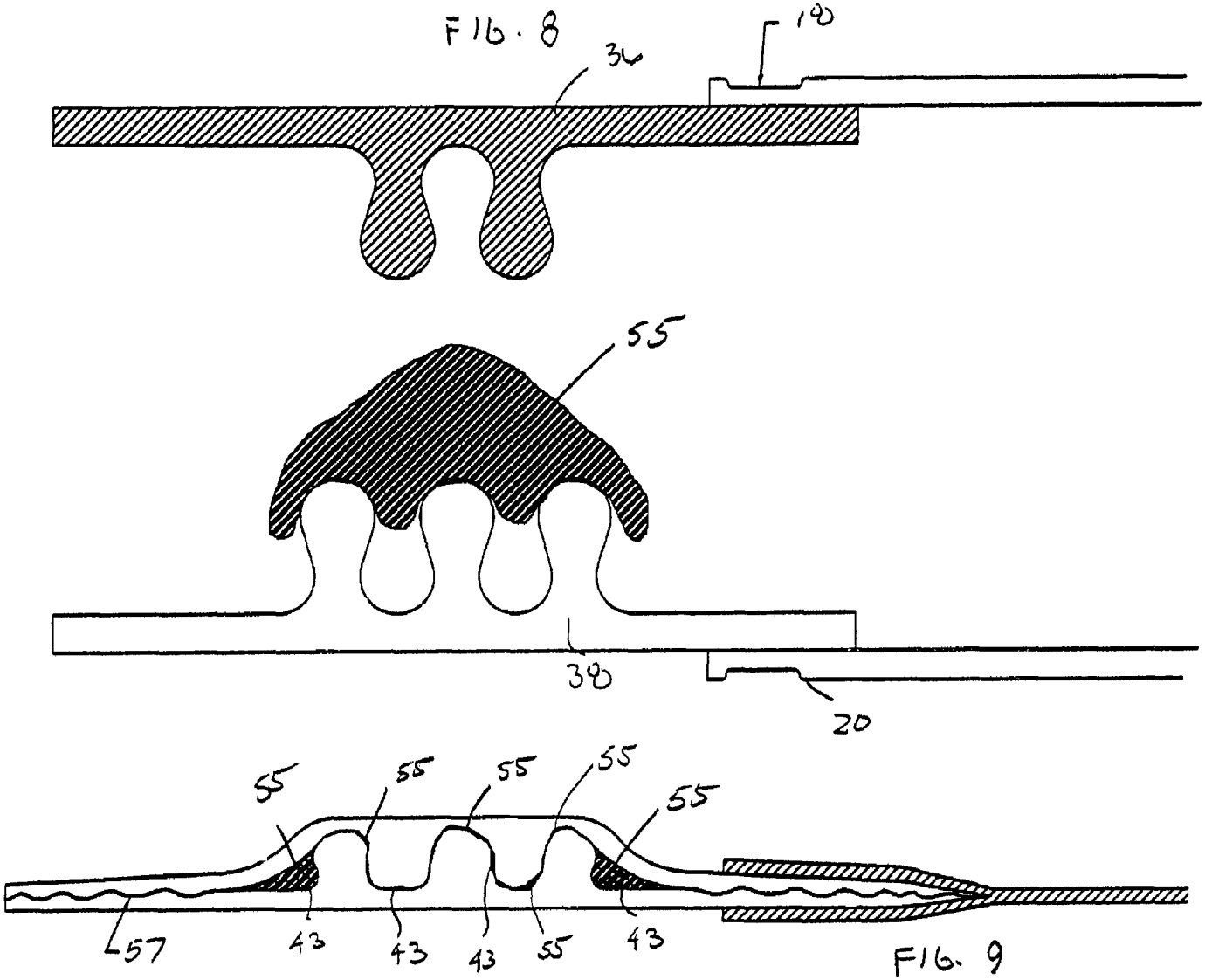
FIG. 8 is a schematic cross-sectional view of a zippered closure of a bag before crushing in accord with an embodiment of the present invention.
FIG. 9 is a schematic cross-sectional view of the zippered closure of FIG. 8 after crushing in accord with an embodiment of the present invention.

To solve this problem, as shown in FIGS. 8 and 9, a sealing material 55 is preferably placed on the back profile 38 at the first and second ends 40 and 42 of the zippered closure 14. When the ends of zippered closure 14 are melted and crushed, the sealing material 55 is either also melted, or if still liquid, flows into any voids 43 occurring as a result of the crushing, and into the transition area 53 between the crushed section 49 and intact portion 51 of the zippered closure 14. This flow into the voids 43 creates a gasket effect ensuring airtightness of the bag 12.

The sealing material 55 is preferably a glue, and most preferably a thermally activated glue, such as Ellsworth Adhesives HM-302-C, and Valley Adhesives EM-900. Alternatively, the glue may be cured by ultraviolet (UV) light, or chemically cured. A preferred amount of sealing material is approximately 0.10 gram per bag, or 0.05 gram at each end of the bag. Other than glue, other plastic or meltable materials, such as polyethylene may be used as the sealing material 55.

Figure 10:
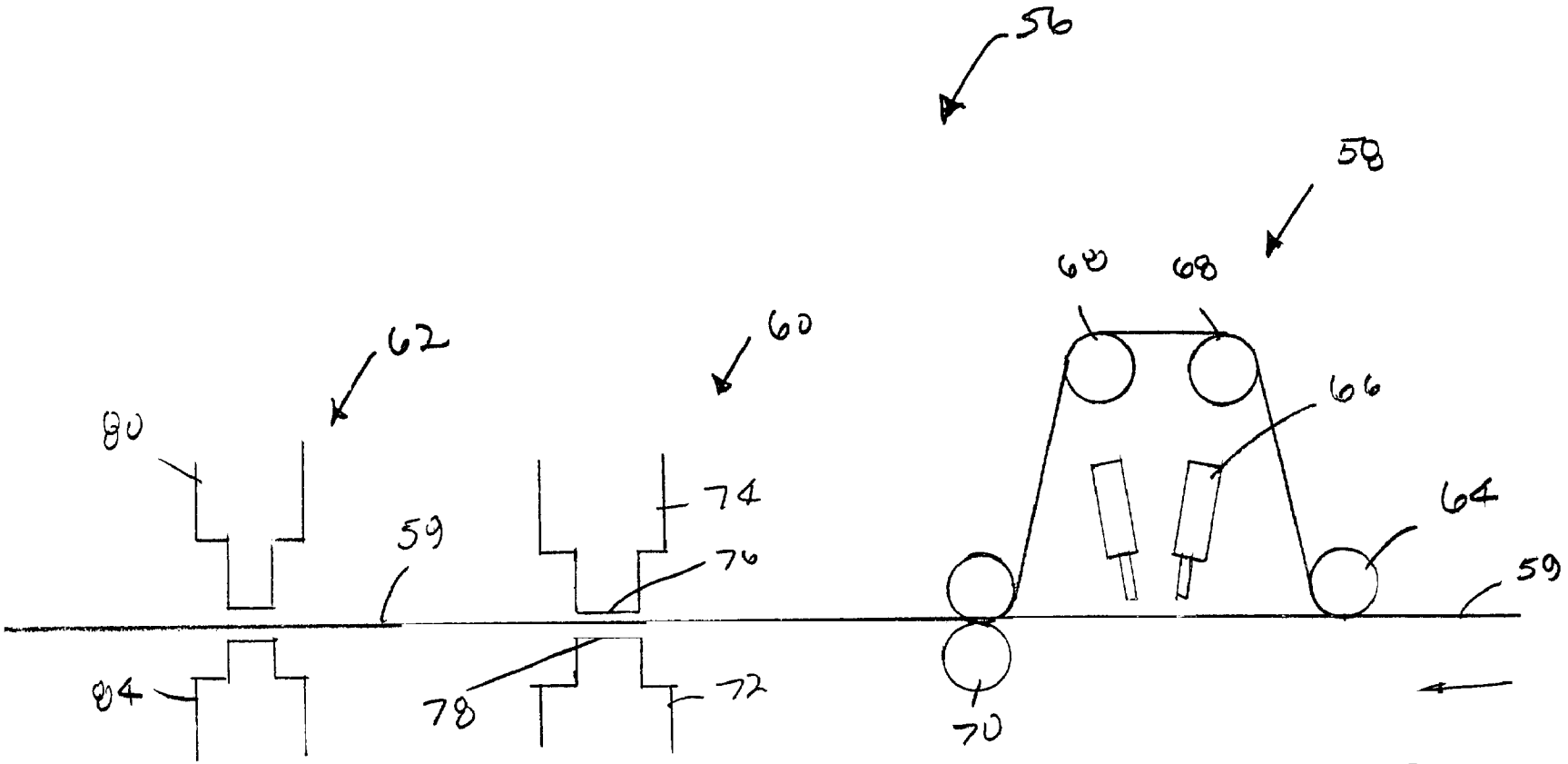
FIG. 10 is a schematic diagram of a method of making a bag in accord with an embodiment of the present invention

FIG. 10 shows a schematic view of a portion of the process 56 by which the bag 12 is made with the sealing material 55 placed between the front zipper profile 36 and back zipper profile 38. The process 56 includes a zipper separation and glue application station 58, a zipper crushing station 60, and a side seal station 62.

The zipper separation and glue application station 58 includes a zipper opening roller 64. Tension from the roller 64 pulls the zipper apart. Station 58 also includes glue applicators 66, tension rollers 68, and pinch rollers 70.

The zipper crushing station 60 includes a lower die 72 and upper die 74. The lower die 72 and upper die 74 have substantially flat sections 76 and 78. The lower die 72 and upper die 74 are heated and pressed together at the substantially flat sections 76 and 78 to create the crushed section 49 of the zippered closure 14. Preferably, the upper and lower dies 72 and 74 are heated to approximately 350° F. Only one of upper or lower dies 72 or 74 need be heated, but both are preferably heated. The crushed section 49 is created by melting together the front zipper profile 36 and rear zipper profile 38. Alternatively, ultrasonic welding may be used to create the end stomps.

The side seal station 62 has a sealing head 80 and a platform 82 that extends the longitude of the web 59. The sealing head 80 is heated and meets the platform 82 for a predetermined amount of time to heat seal the front 18 and back 20 together at their inner surfaces 22 and 26. In a preferred embodiment, only the sealing head 80 is heated, but the platform 82 may also be heated. The sealing head 80 is heated to approximately 300° F. To create separate bags 12, the web 59 is cut along the center of the length of the heat seal created by the sealing head 80. The cutting operation (not shown) may occur at any suitable place in the process.

Figure 11:
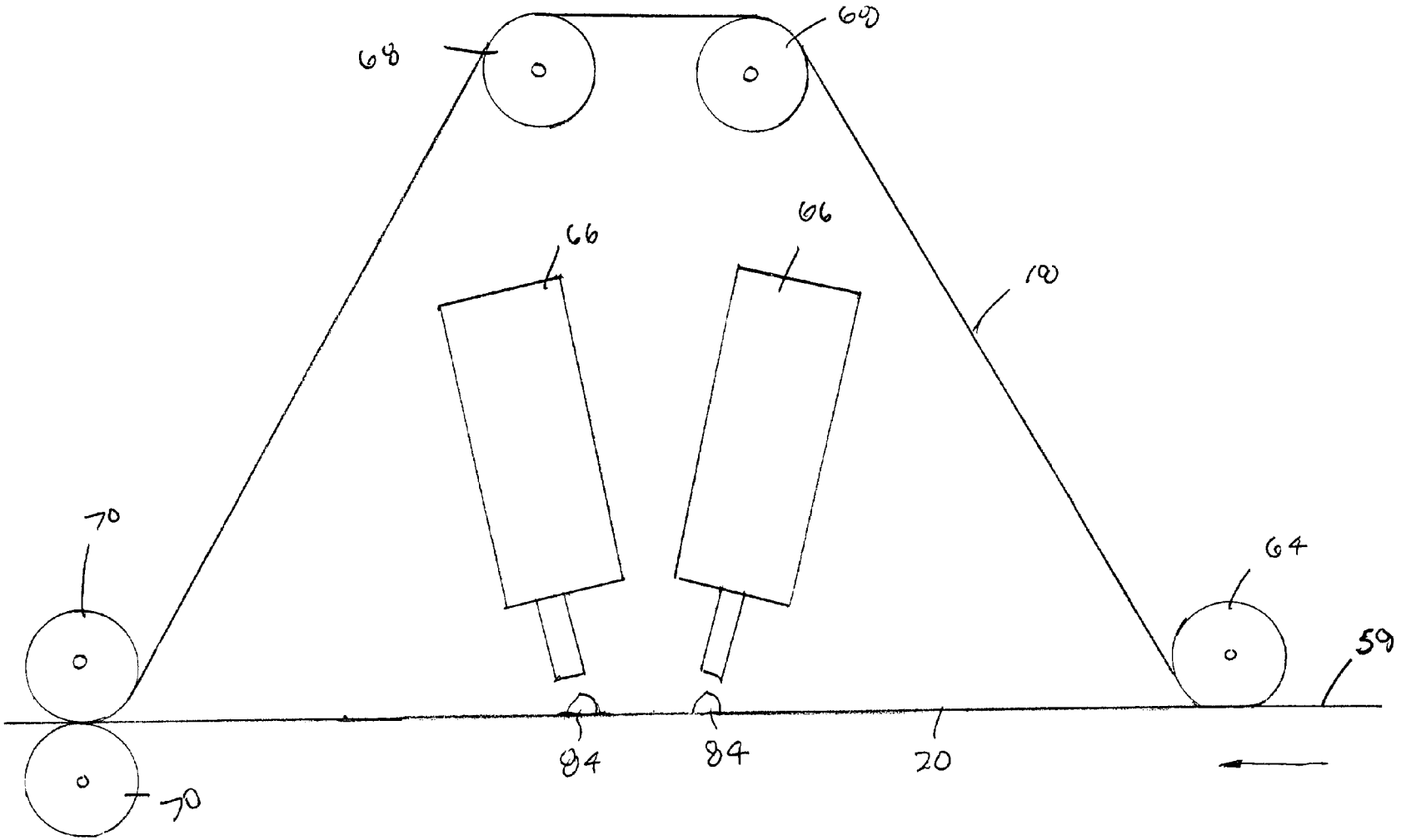
FIG. 11 is a schematic view of a zipper separation and glue application station in accord with an embodiment of the present invention.

As shown in FIGS. 10 and 11, the web 59 enters the zipper separation and glue application station 58 in the direction shown by arrow 64. The web 59 includes the front 18 and back 20 with the front zipper profile 36 attached to the inner surface 22 of the front 18, and the back zipper profile 38 attached to the inner surface 26 of the back 20. The front and back zipper profiles 36 and 38 are initially interlocked. As the web 59 enters the encounters the zipper opening roller 64, the front zipper profile 36 and back zipper profile 38 are separated. The front 18 and front zipper profile 36 are directed over tension rollers 68, while the back 20 and back zipper profile 38 are continue under glue applicators 66. Two drops 84 of sealing material 55 are placed on top of the back zipper profile 38. As the web 59 continues to advance, pinch rollers 70 close and interlock the front and back zipper profiles 36 and 38. At this point the drops 84 are still liquid such that the sealing material 55 flows between the front and back zipper profiles 36 and 38 as they are interlocked by the pinch rollers 70.

After the web 59 exits station 58, it encounters the zipper crushing station 60. There, the front and back zipper profiles 36 and 38 are melted and crushed between the upper and lower dies 72 and 74. The upper and lower dies 72 and 74 being heated, they reheat the drops 84 of sealing material 55 causing the sealing material 55 to move into the voids 43 as shown in FIG. 9. After the crushing station 60, the web 59 proceeds to the side seal station where the sides 30 of the bags 12 are created by sealing head 80. The bags are cut in the middle of the width of the sealing head 80, thus making a left seal of one bag 12 and the right seal of another. After side sealing, the bottom of the bag 12 is also sealed.

Figure 12:
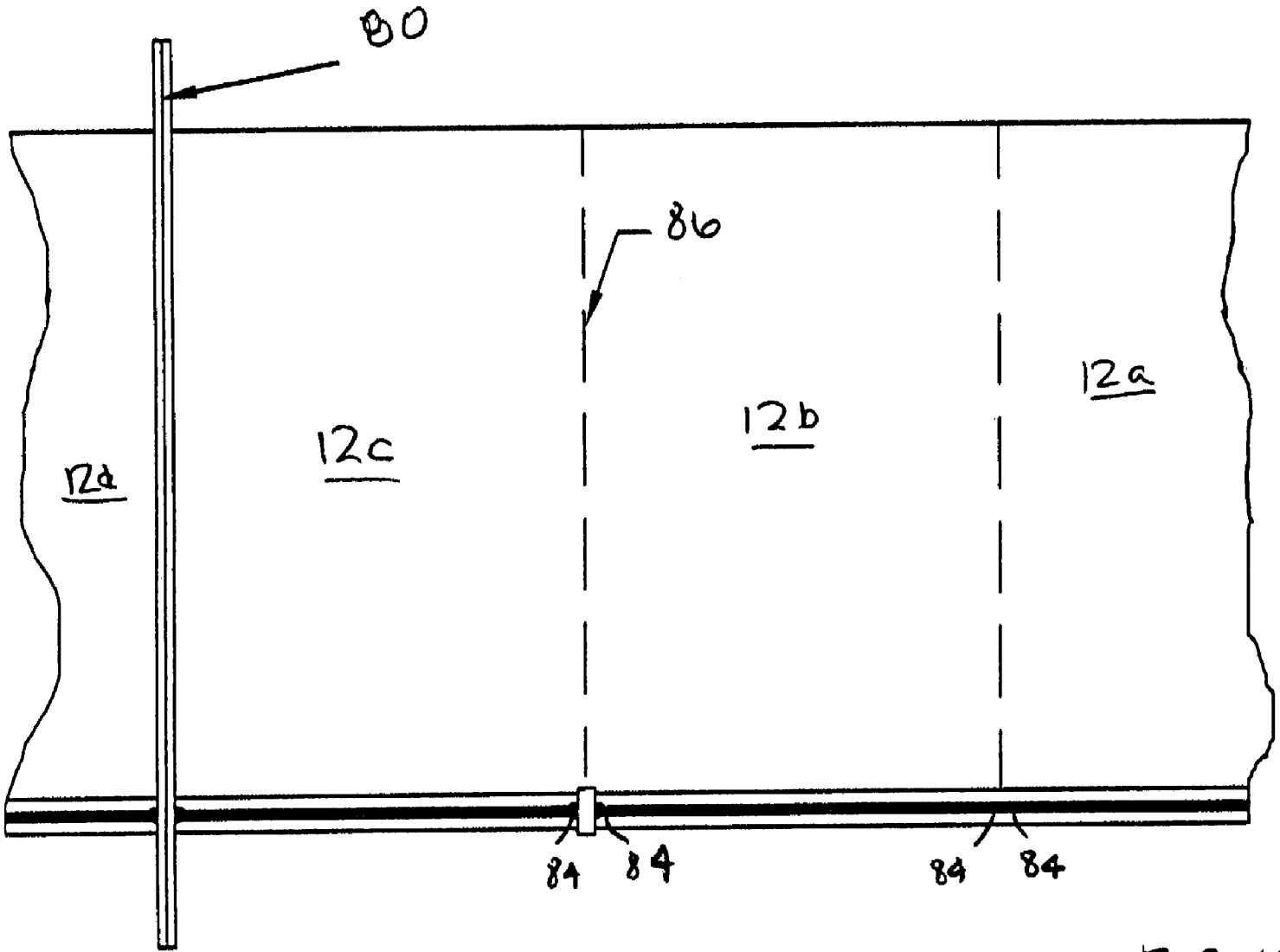
FIG. 12 is a top schematic view of a web of bags in accord with an embodiment of the present invention.

FIG. 12 is a top view showing a series of bags 12 in the web 59 as they continue through the stations. FIG. 12 shows four bags 12*a*-12*d*. A tentative bag edge 86 is established such that one drop 84 of sealing material 55 is on either side of the tentative edge 86 of bags 12*a* and 12*b*. At the tentative edge 86 between the next two bags 12*b* and 12*c*, the zipper is crushed. Between bags 12*c* and 12*d*, the side sealer head 80 seals the side of the bag forming seal 30. The side seal 30 is cut halfway along its width such that after being cut, it forms the side seals of bags 12*c* and 12*d*.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A zippered closure, the zippered closure having a first end and a second end and a top, and comprising:

a front zipper profile and a back zipper profile;

a first crushed section at the first end of the zippered closure, the zippered closure further including an intact portion;

a first transition area between the first crushed section and the intact portion; and a sealing material in the first transition area contained within the front and back zipper profile and not having any portion extending beyond the top of the zippered closure.

2. The zippered closure of claim 1, including a second crushed section at the second end of the zippered closure, a second transition area between the second crushed section and the intact portion, and a sealing material in the second transition area.

3. The zippered closure of claim 1, wherein the sealing material is thermally activated.

4. The zippered closure of claim 3, wherein the thermally activated sealing material is glue.

5. The zippered closure of claim 3, wherein the first crushed section at the first end of the zippered closure is created by a heated die, the heated die heating at least a portion of the thermally activated sealing material.

6. The zippered closure of claim 3, wherein the first crushed section at the first end of the zippered closure is created by ultrasonic welding.

7. The zippered closure of claim 1, wherein the sealing material is curable with light.

8. The zippered closure of claim 7, wherein the light is ultraviolet light.

9. The zippered closure of claim 1, wherein the sealing material is chemically curable.

10. The zippered closure of claim 1, wherein the sealing material is a plastic material.

11. The zippered closure of claim 10, wherein the sealing material is polyethylene.

* * * * *